US008439556B2

(12) United States Patent
Queval

(10) Patent No.: US 8,439,556 B2
(45) Date of Patent: May 14, 2013

(54) SYNCHRONOUS ESCAPEMENT FOR A TIMEPIECE MECHANISM

(75) Inventor: Arthur Queval, Neuchâtel (CH)

(73) Assignee: Nivarox-FAR S.A., Le Locle (CH)

( * ) Notice: Subject to any disclaimer, the term of this patent is extended or adjusted under 35 U.S.C. 154(b) by 34 days.

(21) Appl. No.: 13/272,330

(22) Filed: Oct. 13, 2011

(65) Prior Publication Data

US 2012/0113764 A1 May 10, 2012

(30) Foreign Application Priority Data

Nov. 4, 2010 (EP) ..... 10189996

(51) Int. Cl.
*G04B 15/00* (2006.01)

(52) U.S. Cl.
USPC ..... 368/127

(58) Field of Classification Search ..... 368/169, 368/124, 127–132; 968/98
See application file for complete search history.

(56) References Cited

U.S. PATENT DOCUMENTS

| | | | | |
|---|---|---|---|---|
| 40,508 | A | 11/1863 | Stephenson | |
| 180,290 | A | 7/1876 | Voigt | |
| 7,604,395 | B2 * | 10/2009 | Cabezas et al. | 368/127 |
| 7,661,874 | B2 * | 2/2010 | Conus et al. | 368/131 |
| 8,308,346 | B2 * | 11/2012 | Conus et al. | 368/131 |
| 2007/0140066 | A1 | 6/2007 | Lechot et al. | |

FOREIGN PATENT DOCUMENTS

| | | | |
|---|---|---|---|
| CH | 3299 | A1 | 3/1891 |
| CH | 700091 | A1 | 7/2010 |
| EP | 0018796 | A2 | 4/1980 |
| EP | 0018796 | B1 | 11/1984 |
| EP | 1538490 | A1 | 6/2005 |
| EP | 1538491 | A1 | 6/2005 |
| EP | 1544689 | A1 | 6/2005 |
| EP | 1522001 | B1 | 8/2006 |
| EP | 1708046 | A1 | 10/2006 |
| EP | 1708047 | A1 | 10/2006 |
| EP | 1770452 | A1 | 4/2007 |
| EP | 1801668 | A1 | 6/2007 |
| EP | 1860511 | A1 | 11/2007 |
| EP | 2221677 | A1 | 8/2010 |
| EP | 2224292 | A2 | 9/2010 |

OTHER PUBLICATIONS

European Search Report for EP 10 18 9996 dated May 3, 2011.

* cited by examiner

*Primary Examiner* — Edwin A. Leon
(74) *Attorney, Agent, or Firm* — Sughrue Mion, PLLC

(57) ABSTRACT

Escape wheel (1) including a toothed impulse wheel (2) and a toothed release wheel (4) pivoting synchronously about an axis (D1). The toothed release wheel (4) includes moveable gears (5) each with a release tooth (6), radially moveable relative to the axis (D1) and returned to a position of balance by first return device (7), and a locking tooth (8), returned in a first radial direction (S1) towards a stop member by second return device (9). The impulse tooth (6) includes drive device (11) arranged to cooperate, when the impulse tooth moves in a second opposite radial direction (S2), with complementary drive device (12) of the locking tooth (8) for driving the locking tooth in the second direction (S2) and, when the impulse tooth moves in the first direction (S1), to remain at a distance from the complementary drive device (12) without driving the locking tooth (8).

22 Claims, 10 Drawing Sheets

SYNCHRONOUS ESCAPEMENT FOR A TIMEPIECE MECHANISM

This application claims priority from European Patent Application No. 10187896.5 filed Oct. 10, 2010, the entire disclosure of which is incorporated herein by reference.

FIELD OF THE INVENTION

The invention concerns an escape wheel for a timepiece mechanism, including a plurality of toothed wheels, which are coaxial and pivot synchronously about a pivot axis and include at least a first toothed impulse wheel in a first impulse plane and at least a second toothed release wheel in a second stopping plane, parallel to or merged with the first impulse plane.

The invention also concerns an escape mechanism which includes, pivoting relative to a plate, at least one escape wheel of this type, receiving pivoting torque from energy transmission or storage means which may or may not be integrated in said mechanism, and at least one balance pivoting about a balance axis and including at least one impulse surface, one manoeuvring surface and one unlocking surface.

The invention also concerns a timepiece movement including energy storage and transmission means for transmitting a pivoting torque, and including at least one escape mechanism of this type driven by the pivoting torque and/or at least one escape wheel of this type arranged to pivot under the effect of said pivoting torque and transmit said torque in the form of a periodic impulse to a balance comprised in the movement.

The invention further concerns a timepiece including at least one timepiece movement of this type and/or at least one escape mechanism of this type and/or at least one escape wheel of this type.

The invention concerns the field of horology, and more specifically the field of escape mechanisms.

BACKGROUND OF THE INVENTION

Few of the known escapements combine efficiency and accuracy:

- Swiss lever escapements are reliable and robust, but with low output because the impulse passes through a friction plane, via pallets;
- coaxial or Daniels escapements have bitangential impulses, and consequently are more efficient, but the components and assembly thereof are complex and expensive;
- frictional rest escapements do not have a lever, they include a single wheel giving a single impulse to the balance, but the wheel is in prolonged contact with the balance, thereby wasting energy through friction and disruption to the regulating member;
- detent escape mechanisms are reputed to be the most accurate, and have long been reserved for marine chronometers. They have a single impulse, in a single oscillation of the balance and are the mechanisms offering the best mechanical efficiency.

The efficiency of detent escape mechanisms is greater than that of lever escapements, because the escape wheel only imparts an impulse to the balance once per oscillation, during which the escape wheel pivots through one angular step. Consequently, energy wasted due to the inertia of the escape wheel occurs once per oscillation, as opposed to once per vibration in lever escapements.

The use of detent escapements in wristwatches is more complex, because of the sensitivity of such escapements to shocks.

Most detent escapements include a detent lever also called a brake-lever, which includes locking means, formed by at least one locking stone for holding the escape wheel in the locked position. This lever also includes an actuating finger or beak, which may also be formed by the end of a spring secured to the lever, to cooperate with a discharging pallet comprised in a roller integral with the balance, or even with a notch in said roller.

The balance also carries, generally on another roller, an impulse pallet. When the escape wheel is released, the barrel torque is transmitted by the escape wheel to the impulse pallet, which maintains the alternate pivoting movement of the balance.

In short, the escape wheel is released when the balance rollers pivot in one direction, and it remains locked when the rollers pivot in the other direction. Consequently, the impulse is only given once per oscillation.

In the event of shocks, particularly lateral shocks, if the balance is made to pivot outside its normal amplitude, one tooth of the escape wheel may leave the locking stone, and unlocking and impulses occur twice in the same vibration. The effect of this phenomenon, called "tripping", is to distort the isochronism of the oscillator.

U.S. Pat. No. 40,508 in the name of James Stephenson, dated 1863, discloses an escapement according to the conventional model, wherein the lever beak cooperating with the discharging pallet is formed by a strip spring fixed to the detent escapement.

U.S. Pat. No. 180,290 in the mane of F. Herman Voigt, dated 1876, also discloses a spring mechanism, this time hooked to the felloe of the balance.

CH Patent No. 3299, in the name of Emile James, dated 1891, discloses a mechanism wherein the detent-lever is carried by a mainspring, and wherein the escape wheel is held on the lock in the event of shaking or a shock. A first roller of the balance includes a lifting piece which cooperates with a strip spring secured to the detent lever. The latter has a beak which, when the lifting piece lifts the detent, cooperates with a notch in a second balance roller, parallel to the first. In the event of shock, the spiral spring on which the detent is mounted tends to keep the escape wheel pressed against the locking stone. This mechanism can be applied to detent-spring escapements.

Detent escapements did not change very much during the twentieth century.

The Daniels escapement, known from EP Patent No. 0 018 796 in the name of George Daniels and dated 1984 will, however, be cited. This escapement is slightly different from conventional detent escapements, but it includes the main characteristics, notably a lever cooperating, on the one hand, with a balance pin, and on the other hand with a first external escape wheel, which imparts the impulse to the balance, through two entry and exit pallets, and with a second escape wheel coaxial to the first via a separate impulse pallet.

It was not until 2005 that new detent escapements dedicated to wristwatches were disclosed.

EP Patent No. 1 538 490 in the name of MONTRES BREGUET SA discloses an escapement of this type, including a lever-detent with a locking stone and a first actuating finger. The latter cooperates with a second actuating finger mounted on a very long resilient member pivoting on the balance roller that carries the impulse pallet. This second finger can drive the first finger when the roller is pivoting in a first direction to actuate the lever, and can bypass the finger without driving it when the roller is pivoting in the opposite direction. This resilient member includes an aperture that moves around a first pin carried by the roller, which also carries a second pin that may or may not cooperate with the resilient member, depending upon the level of tension or extent to which said member is let down. In another embodiment, the resilient member of this escapement is on the lever, and not on the roller. This resilient member may consist of a spiral spring, or a serpentine spring.

Various improvements and variants follow, in Patents EP 1 538491, EP 1 544689, EP 1 708046 and EP 1 708047, in the name of MONTRES BREGUET SA.

The first, EP 1 538491, discloses a mechanism which has no resilient member on the detent, but has a resilient member carrying the second actuating finger on the roller. Said roller is provided with a cam notch in which a beak, located at the end of a feeler arm of the detent lever, moves.

EP Patent No. 1 544689 discloses a similar mechanism, but with no resilient member, wherein the second actuating finger is positioned opposite the cam notch and cooperates with one or other side of the first finger of the detent-lever depending upon the direction in which the roller is pivoting, to drive or hold the locking stone. The function of the second actuating finger is to re-engage the locking stone in the escape wheel, and no feeler arm with a beak is used.

EP Patent No. 1 708047 discloses a lever including an arm carrying both a first finger, for cooperating with the second actuating finger, and a feeler with a beak cooperating with a cam notch similar to the preceding ones. When the balance and rollers pivot in a first direction, the first finger drives the second finger to unlock the locking stone(s) from the escape wheel. The feeler arm beak is then driven by a rising flank of the cam notch to re-engage the locking means in the escape wheel. When the balance pivots in the opposite direction, the first finger drives the second finger to keep the locking means engaged in the escape wheel. When the first and second fingers meet, in whatever direction the rollers are pivoting, a natural rotating force is generated on the lever arbour. This encounter does not generate any risk of breaking the mechanism. No resilient member or stop pins are necessary. In a particular embodiment, this mechanism includes two juxtaposed locking stones including contiguous but non-aligned locking faces, which enables the tip of the escape wheel tooth to be housed on a locking line at the junction of the locking faces, creating a draw effect which dispenses with the need for any stop pin. The locking face of the locking stone closest to the escape wheel rises up before the tooth and prevents it from continuing on its way. In this total lock position of the escape wheel tooth, the beak of the feeler arm moves away from the periphery of the roller leaving the balance completely free to complete the first vibration. This design makes the escapement resistant to shocks. Indeed, a shock returns the beak onto the periphery of the corresponding roller, without however unlocking the locking stones, since the return of the tooth onto the locking line occurs immediately owing to the draw effect. When, afterwards, during the return movement of the balance in the opposite direction towards the end of the second vibration, the first finger and the second finger come into cooperation, they create torque in the detent lever around its pivot axis, causing a slight recoil of the escape wheel tooth, before the tooth returns to the locking line in an anti-draw effect, when the fingers separate.

EP Patent No. 1 708046 discloses an improvement applicable to these various versions, in the form of a safety finger fixed to the roller, and arranged to cooperate with the teeth of the escape wheel and lock said wheel if the impulse pallet is accidentally released from the toothing of the wheel. This arrangement prevents the escape wheel from racing in the event of a shock which results in the direction of rotation of the rollers being reversed at the precise moment of the wheel impulse. The collision of one tooth of the wheel with this safety finger locks the wheel and returns the rollers to the proper direction of rotation.

These Patents therefore proposed both simplifying and making the detent escapement more secure.

Other documents have proposed other solutions.

Thus, EP Patent No. 1 522001, in the name of Detra SA and Patek Philippe SA also published in 2005 proposes an escape mechanism with locking parts and toothed wheels with gaps in the toothing. The first wheel set is subjected to a periodic torque, obtained for example by a rotor mounted in a stator. This first wheel set includes, on the one hand, in a basic plane, a first wheel with gaps in the toothing over the periphery thereof, and on the other hand, in a second plane, a first brake-lever including several teeth and able to lock a release lever comprised in a balance roller, when the balance pivots in a first direction. Depending upon its position, this first wheel set cooperates with a second wheel set, either via the first brake-lever or via the first wheel thereof. This second wheel set includes, in the basic plane, a second wheel with toothing gaps, in the second plane, a shaped part which includes several fingers and can lock the balance roller release lever in a second direction of pivoting opposite to the first. The second wheel set further includes a locking part in a first plane parallel to the preceding planes. Depending upon its position, this second wheel set cooperates, either via the locking part, or via the second wheel thereof, with an escape wheel, which includes, in the basic plane, a toothed wheel with toothing gaps, and in the first plane, an impulse wheel, which receives a continuous mechanical torque such as that from a barrel, similar to a conventional escape wheel, and can cooperate with the impulse lever comprised in the balance roller, to maintain the oscillating movement of the balance. Depending upon the respective angular positions of the various wheel sets, the locking parts, or shaped parts, or teeth, cooperate with each other, such that the device has four stable locking positions for each revolution of the first pin, between which it has the same number of unlocking positions. The combination of two locking means and two unlocking means for the mechanical torque, and the particular sequence imposing an unlocking operation between two locking operations prevent any racing or tripping in the event of a shock to the mechanism. This mechanism is complex, relatively expensive and extends over several planes, which gives it significant thickness.

EP Patent No. 1 770 452 in the name of Peter Baumberger is an improvement of the former Voigt U.S. Pat. No. 180,290 devised to minimise the requirement for space, and it discloses a conventional detent escapement with a detent lever that pivots and is returned by a spiral spring, one arm of the lever carries one end of a strip spring, the other end of which is held abutting on a stop member carried by another arm of the lever, and is arranged to cooperate with a unlocking stone integral with a small roller of the balance. Another arm of the lever, beyond a locking stone, includes a finger which cooperates with the periphery of this small roller, and in particular with a truncated portion forming a cam, at a lower level than that of the strip spring. A large balance roller conventionally carries an impulse pallet, preceded by a first recess, and followed by a second recess, to allow the locking stone to be unlocked when the locking stone pivots the detent lever. The selection of a particular geometry, both as regards the position of the locking stone and the impulse pallet in quasi-symmetry with the line at the centres of the escape wheel and the balance during the locking phase, and the fork formed by the finger and the free end of the strip spring, limit the disruptive effect linked to the detent inertia on the balance oscillations. The amplitude of the pivoting movements of the detent, in the event of shock, is limited by the interaction of the locking stone and the large roller. In a complementary embodiment, this mechanism includes an anti-trip lever, in proximity to the small roller, pivotably mounted on the movement between two stable end positions maintained by a jumper spring on stop members with which a first end can cooperate and the second fork-shaped end of which interacts with the discharging pallet: each time the discharging pallet passes into the fork it exerts pressure to tip the anti-trip lever from one stable position to the other. The fork thus forms two stops for the small roller in the event of any tripping, and prevents the balance from pivoting through more than one revolution.

EP Patent No. 1 860 511 in the name of Christophe Claret SA discloses a movement with a moveable bridge, providing protection for a detent escapement against lateral shocks. This moveable bridge carries the sprung-balance pivot axis, the escape wheel pivot axis, the detent pivot axis and part of the gear train. It is pivoted elastically on the arbour of one of the gear train wheels, for example the seconds wheel. Forces, such as a lateral shock, capable of unlocking the locking stone, then drive the entire moveable bridge and the relative positions of the detent and the escape wheel are maintained. This ensures constant operation of the escapement. The moveable bridge may also be dampened by a dampening system which dissipates part of the energy due to the shock.

EP Patent No. 2 221677 in the name of Rolex SA discloses an innovative detent escapement, which includes an inertia mass that can be pivoted relative to the balance roller under the effect of acceleration of the balance. This inertia mass carries the unlocking finger, whose function is to cooperate with the detent lever finger. The mass is pivoted on an off-centre arbour of the roller and the angular clearance thereof is limited by the travel of a pin in a elongated hole, which corresponds to two stable positions, i.e. one in each direction of pivoting of the balance. Thus, depending upon the acceleration of the balance, the unlocking finger either does or does not protrude relative to the balance roller, and therefore is, or is not able to engage the detent lever finger. The unlocking finger does not, therefore, have to overcome the resistance of any elastic member to pass the obstacle of the detent lever finger during the vibration in which the balance does not receive an impulse for its oscillating movement, since the unlocking finger is withdrawn and remains set back from the edge of the roller. There is no loss of energy or disruption to the oscillation period of the balance.

CH Patent Application No 700 091 in the name of Christophe Claret SA discloses a detent escapement with a detent lever, which is pivotably mounted on a spiral spring and cooperates at the other end with a first strip spring embedded in proximity to the pivot. The balance roller includes two distinct discharging pallets. A wheel set, arranged on the opposite side of the escape wheel relative to the detent lever, carries a pivoting cam, which holds a cam strip spring and is returned towards the detent by a spiral spring onto a stop position. This cam is arranged for making the cam strip spring cooperate, either in a first state, with the end of the lever carrying the strip spring, or in a second state, with the discharging pallets of the balance. The first discharging pallet is arranged to cooperate with the first strip spring and actuate the detent when the first pallet encounters the first strip in a first direction, and to cooperate only with the first strip without actuating the detent when it encounters the first strip in the opposite direction. When the cam is in the first state it cooperates with the detent to limit the movements thereof. The second discharging pallet is arranged for changing the cam to the second state in which the detent is free to perform its unlocking operation and release the escape wheel tooth from the locking stone. The two discharging pallets are close and arranged such that the cam is brought into its second state just before the detent performs the unlocking operation. The spiral cam return spring, which is stronger than the cam strip spring, tends to return the cam to its first state. Thus, in the first state thereof, the cam is positioned so as to oppose any inadvertent movement of the detent which could result in inadvertent unlocking of the locking stone, and the escapement is less sensitive to the effects of a shock. Adjustment of this mechanism is complex, since it depends upon the features peculiar to the springs comprised therein, of which there are at least three.

EP Patent No. 2 224 292 in the name of Rolex SA discloses a direct impulse escapement, particularly a detent escapement. The detent lever is arranged in a particular manner, pivoting between two stop members. Facing the escape wheel, it has a finger including, in succession, a stop surface used as the locking stone, a safety surface which, depending upon the pivotal position of the lever, either interferes or does not interfere with the escape wheel trajectory, and a sliding surface which forces the lever to tip, when the escape wheel is pivoting, so as to return the sliding surface and thus the stop surface to the area of interference with the escape wheel, to stop said wheel pivoting. The balance roller conventionally includes an impulse pallet and an unlocking finger. During the vibration in a first pivoting direction of the balance, the lever is in a first stopped pivotal position which allows the unlocking finger to pass, whereas in the other vibration in the other pivoting direction, the lever is pivoted into another stop position and encounters the unlocking finger at an elastic unlocking element comprised in said lever. The elastic travel of this elastic unlocking element allows the balance to continue its travel and the impulse pallet passes between two adjacent teeth of the escape wheel. Shortly afterwards, the balance is stopped by the balance spring thereof and pivots in the opposite direction. During this elastic travel, the lever remains butting against the stop member and the stop surface of the lever slides over the escape wheel tooth which is kept stopped. The safety of this mechanism is ensured by the arrangement of the lever finger, with one stop surface and one sliding surface which alternately run into the trajectory of the escape wheel toothing. The length of the safety surface between the stop surface and the sliding surface corresponds to the angle travelled by the wheel to communicate the drive energy to the balance, to prevent the premature return of the stop element into the trajectory of the wheel, which provides additional security. Part of the energy from the barrel is, however, consumed in friction during the sliding phase.

It is clear that these various mechanisms are complex, require many components and may be difficult to adjust.

SUMMARY OF THE INVENTION

The invention proposes to offer an entirely new escape wheel and escape mechanism design, which may, in particular, be used for a detent escapement, with the advantages of high level precision for which this type of escapement is renowned, yet with guaranteed perfect alignments during movement, a greatly reduced number of components, very simple assembly and adjustments that are reduced to a minimum. The design of the escape mechanism according to the invention removes any intermediate components between the escape wheel and the balance, whether they are detent levers, brake-levers or pallets.

The invention thus concerns an escape wheel for a timepiece mechanism, including a plurality of toothed wheels, which are coaxial, pivot synchronously about a pivot axis and include at least a first toothed impulse wheel in a first impulse plane and at least a second toothed release wheel in a second stopping plane, parallel to or merged with the first impulse plane, characterized in that said second toothed release wheel includes at least one moveable gear which includes, on the one hand, at least one release tooth radially moveable relative to said pivot axis and returned to a position of balance by first return means, and on the other hand, at least one locking tooth returned in a first radial direction towards a stop position by second return means, and further characterized in that said release tooth includes drive means, arranged to cooperate, when said release tooth is driven in a second radial direction opposite to said first radial direction, with complementary drive means comprised in said locking tooth to drive said locking tooth in the second radial direction, and in that, when said release tooth is driven in the first radial direction, said drive means is arranged to move at a distance from said complementary drive means without driving said locking tooth.

According to a feature of the invention, said impulse wheel includes the same number of impulse teeth, with tips pointing in the second radial direction, as said second release wheel has said moveable gears, each of which includes a release tooth with a tip pointing in said second radial direction, and in that said impulse teeth are alternated with said release teeth.

According to a feature of the invention said escape wheel 1 is made of micro-machinable material, or silicon, or quartz or a compound thereof, or an alloy derived from MEMS technology, or an alloy obtained via the DRIE or LIGA methods, or made of an at least partially amorphous material.

The invention further concerns an escape mechanism including at least such one escape wheel receiving a pivoting torque from energy transmission or storage means which may or may not be integrated in said mechanism, and at least one balance pivoting about a balance axis and including at least one impulse surface, a manoeuvring surface and an unlocking surface, wherein said escape wheel and balance are pivotally moveable relative to a plate, characterized in that, for each said escape wheel, said plate includes a stop member, which is arranged to cooperate in succession with each said locking tooth in its said stop position to block the pivoting of said escape wheel, and to allow said escape wheel to pivot when said locking tooth is moved away from the stop position thereof by said corresponding release tooth.

According to a feature of the invention, the trajectory of said unlocking surface interferes in succession with that of each said release tooth in order, in a first direction of pivoting of said balance, to hook said release tooth and move it away from said position of balance in the second radial direction by driving said locking tooth to move it away from the said stop position thereof and to allow said escape wheel to pivot.

According to a feature of the invention, during said pivoting of said escape wheel, an impulse tooth imparts sufficient impulse to said impulse surface of said balance for one complete oscillation, during the next vibration of said balance in a second direction of pivoting of said balance, opposite to said first direction of pivoting, the trajectory of said manoeuvring surface interferes in succession with that of each said release tooth to push the latter in the first radial direction so as to allow said balance to continue its pivoting movement without releasing said locking tooth, associated with said release tooth, from said stop member.

According to a feature of the invention, said balance is made in a single piece with said plate.

According to a feature of the invention, said balance is made in a single piece with at least one spiral spring.

According to a feature of the invention, said escape mechanism includes a first single-piece part grouping together said plate, including pivoting guide means arranged for guiding at least one said escape wheel, at least one said balance, at least one said spiral spring coupled to each said balance, and a second single-piece part including at least one said escape wheel including complementary guide means arranged to cooperate with said plate guide means, in order to guide said escape wheel as it pivots, each said wheel being arranged to be coupled to said balance.

According to a feature of the invention, said escape mechanism is made in a micro-machinable material, or silicon, or quartz, or a compound thereof, or of an at least partially amorphous material.

The invention also concerns a timepiece movement including energy storage and transmission means for transmitting a pivoting torque, and including at least one escape mechanism of this type driven by the pivoting torque and/or at least one escape wheel of this type arranged to pivot under the effect of said pivoting torque and transmit said torque in the form of a periodic impulse to a balance comprised in the movement.

The invention further concerns a timepiece including at least one timepiece movement of this type and/or at least one escape mechanism of this type and/or at least one escape wheel of this type.

BRIEF DESCRIPTION OF THE DRAWINGS

Other features and advantages of the invention will appear in the following detailed description, with reference to the annexed drawings, in which.

DETAILED DESCRIPTION OF PREFERRED EMBODIMENTS

The invention concerns the field of horology, and more specifically the field of escape mechanisms.

The invention presents an innovative escape wheel and escape mechanism design, in particular for a detent escapement, with the advantages of high level precision for which this type of escapement is renowned, with perfect geometry during movement, a minimum number of components, very simply assembly, and adjustments reduced to a minimum. The invention dispenses with any intermediate components between the escape wheel and the balance, whether they are detent levers, brake-levers or levers. All of the escapement functions are in fact combined in a single wheel.

The invention concerns a wheel 1, more specifically an escape wheel, for a timepiece mechanism such as a timepiece 1000, a timepiece movement 100, or an escape mechanism 10.

Figure 4:
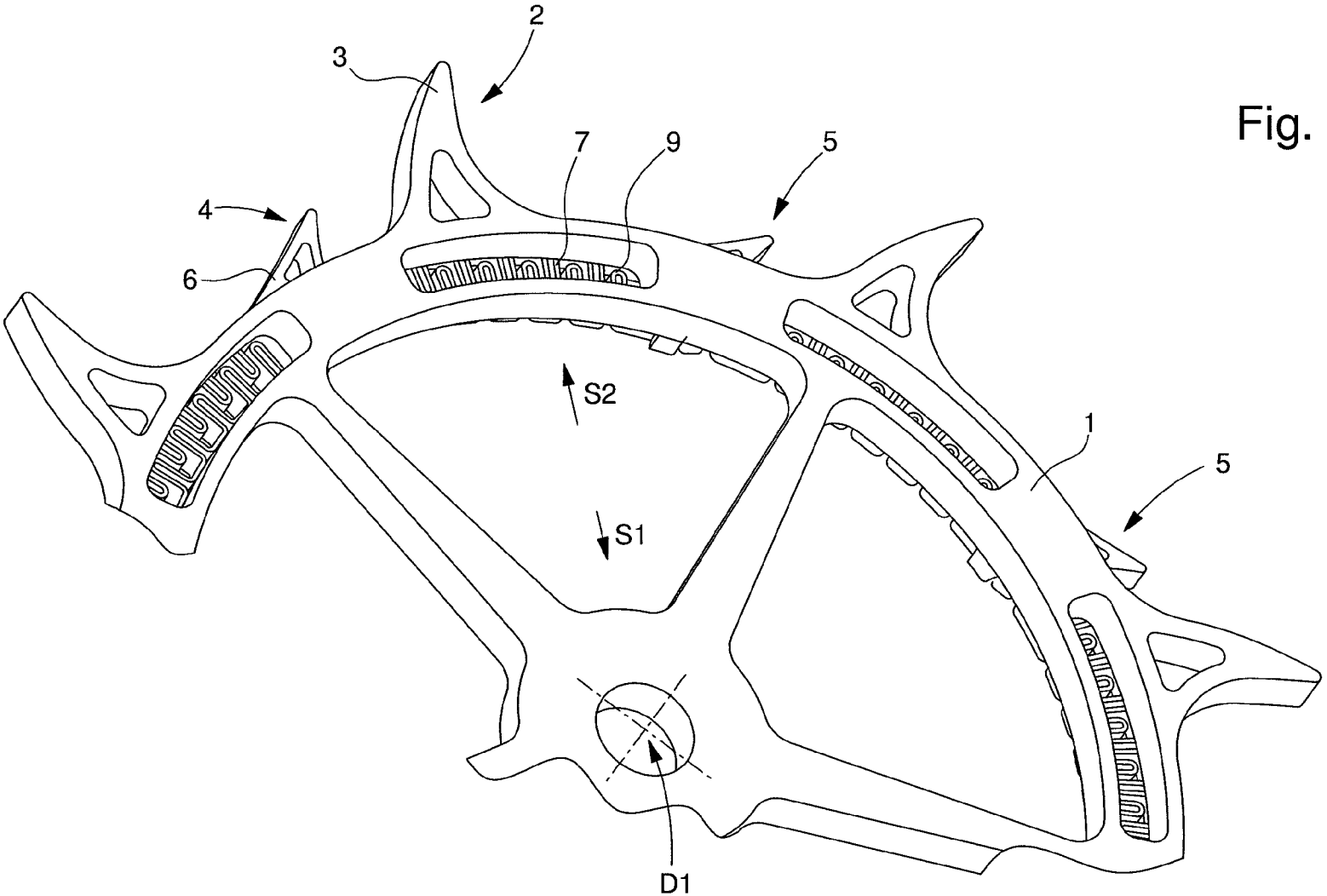
FIG. 4 shows a schematic, partial, perspective view of the escape wheel of FIG. 1, seen from the side of an impulse tooth comprised therein.
Figure 5:
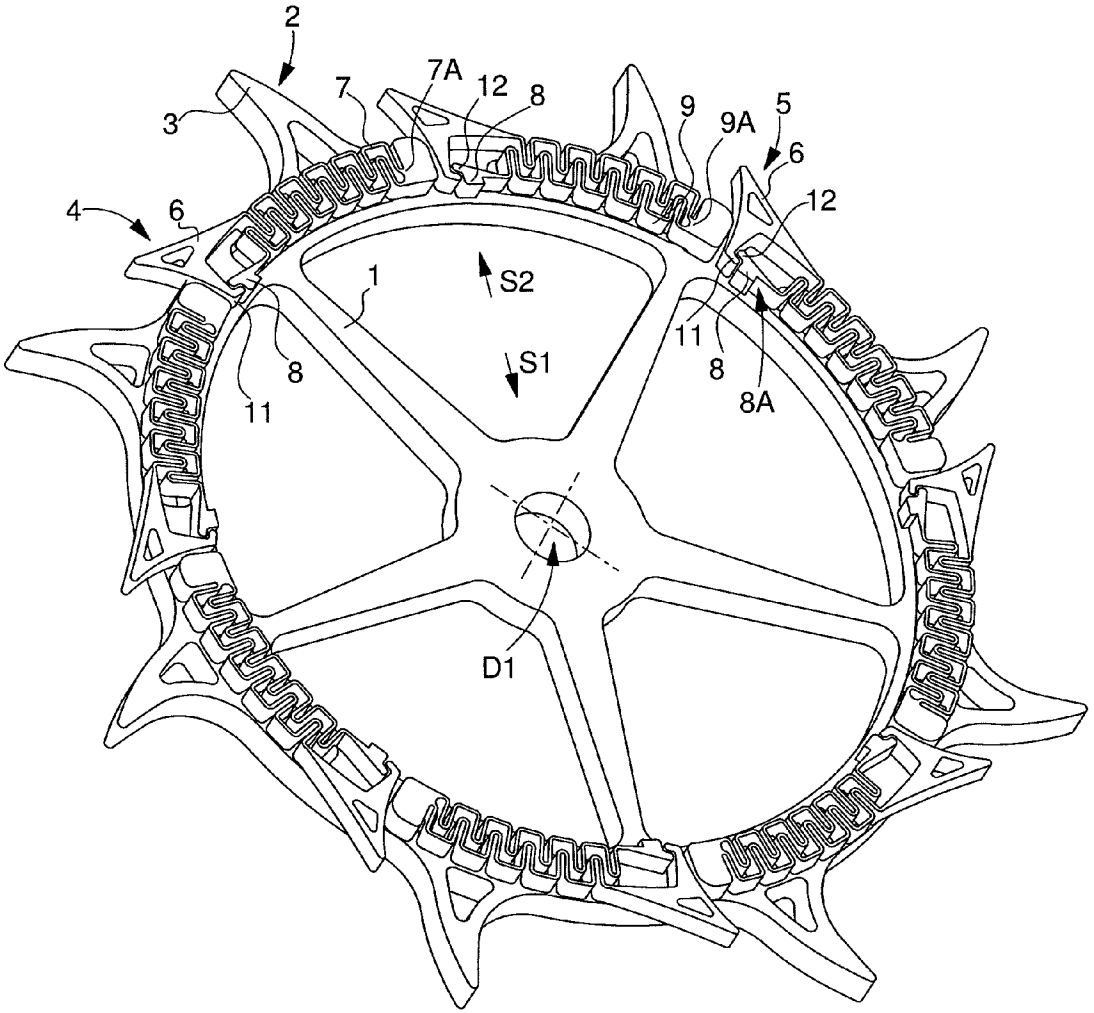
FIG. 5 shows a schematic, perspective, partial view of the escape wheel of FIG. 1 seen from the side of release teeth and locking teeth comprised therein.
Figure 6:
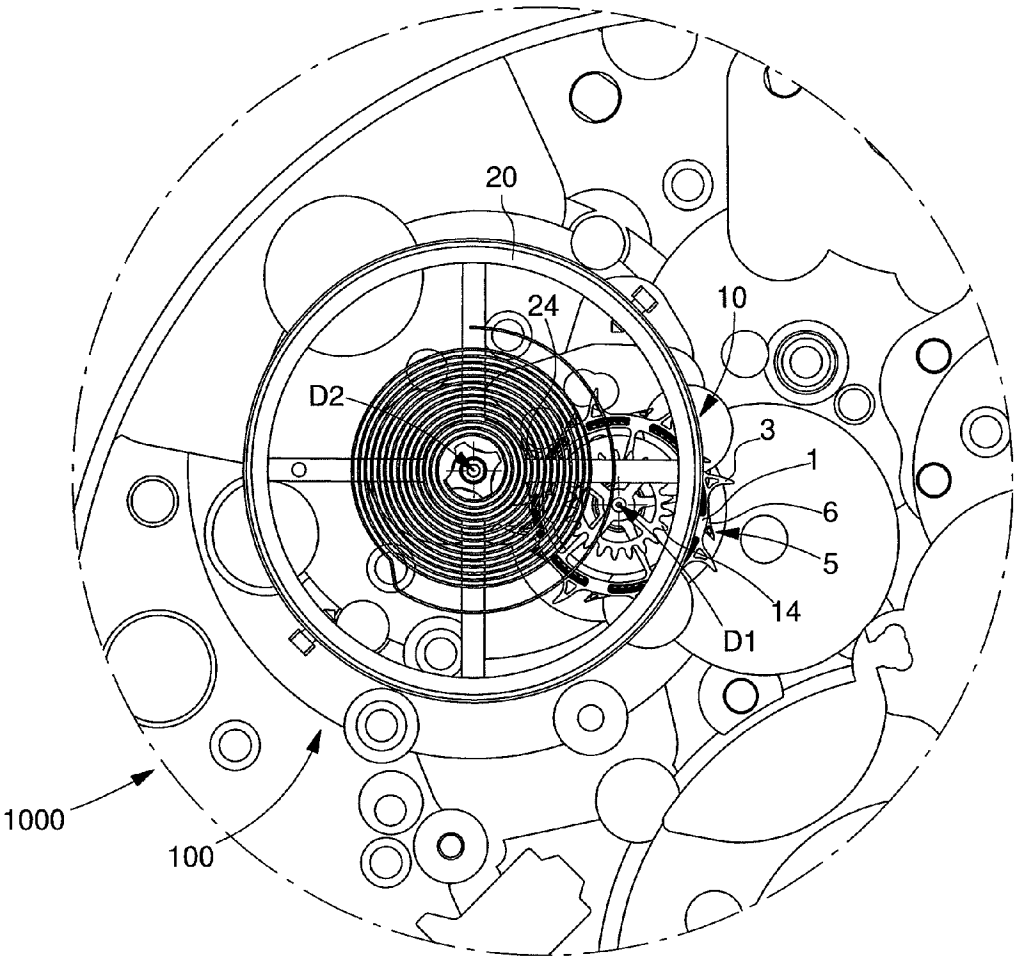
FIG. 6 shows a schematic, partial, plan view of a timepiece including a timepiece movement which itself includes the escape mechanism of FIG. 1 in a release phase.
Figure 7:
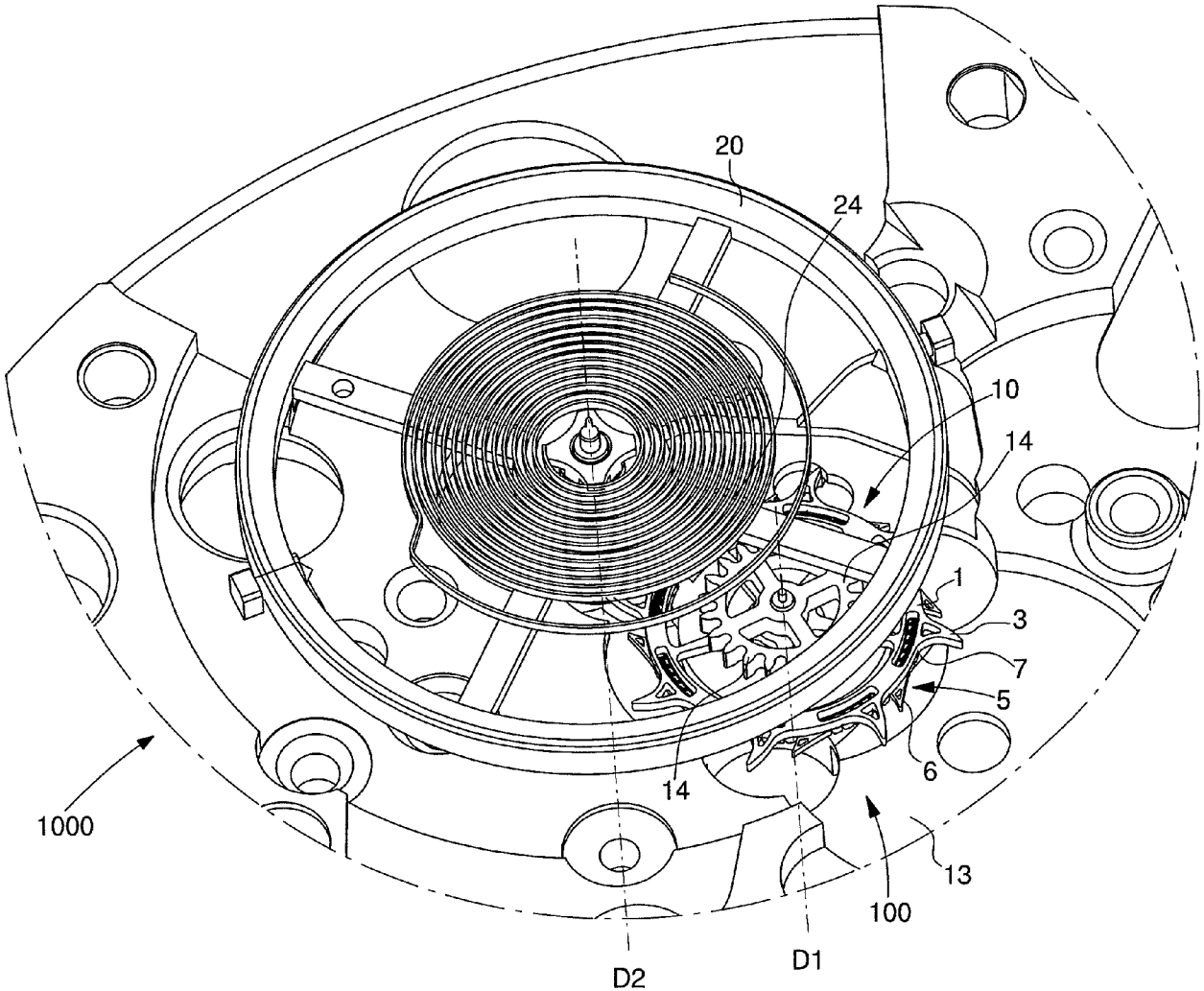
FIG. 7 shows a schematic, partial, plan view of the timepiece of FIG. 6.

This wheel 1 includes a plurality of toothed wheels, which are coaxial, pivot synchronously about a pivot axis D1 and include at least a first toothed impulse wheel 2 in a first impulse plane and at least a second toothed release wheel 4 in a second stopping plane, parallel to or merged with the first impulse plane, as seen in FIGS. 4 and 5 which respectively show an impulse stage including a first toothed impulse wheel 2 and which transmits energy to the balance when the wheel is released, and a wheel unlocking-release stage including a second toothed release wheel 4. It is clear that these stages operate independently, even if they are linked to the same wheel.

The first impulse plane may be merged with the second stopping plane.

In the preferred embodiment set out here, the impulse stage provides a single impulse as in every detent escapement.

According to the invention, the second toothed release wheel 4 includes at least one moveable gear 5. This gear includes, on the one hand, at least one release tooth 6, which can be moved radially relative to pivot axis D1 and is returned to a position of balance by first return means, and on the other hand, at least one locking tooth 8, returned in a first radial direction S1 to a stop position by second return means 9.

More specifically, the release tooth 6 includes drive means 11 arranged, when release tooth 6 moves in a second radial direction S2, opposite to the first radial direction S1, to cooperate with complementary drive means 12, comprised in locking tooth 8, in order to drive locking tooth 8 in the second radial direction S2.

When release tooth 6 moves in the first radial direction S1, drive means 11 is arranged to move at a distance from complementary drive means 12 without driving locking tooth 8.

In each locking phase of wheel 1, locking tooth 8 encounters a stop member 15, fixed relative to a plate 13 of timepiece 1000 or of movement 100, to prevent escape wheel 1 from racing.

Impulse wheel 2 has the same number of impulse teeth 3, whose tips point in the second radial direction S2, as second release wheel 4 has moveable gears 5, each of which has a release tooth 6, whose tip points in second radial direction S2.

Impulse teeth 3 are alternated with release teeth 6.

The Figures show an example wheel 1 with eight impulse teeth 3 and eight moveable gears 5. This example is in no way limiting.

Preferably, the first return means 7 and second return means 9 are elastic return means, particularly of the serpentine spring type as seen in the Figures, or strip or spiral springs.

Preferably, the release tooth 6 forms the end of a first spring 7, the other end 7A of which is embedded in a structure comprised in escape wheel 1. Likewise, locking tooth 8 forms the end of a second spring 9, the other end 9A of which is also embedded in the structure.

In the Figures, which illustrate one embodiment, these springs extend, in the same plane, which is the stopping plane, between two consecutive moveable gears 5, and are shown in the form of serpentine springs which overlap but do not interfere with the contraction or let down of each other. It is also possible to open out the springs in several successive steps, in order to increase the length thereof, thus reducing the force to be exerted on the free end thereof and thereby reducing energy loss. Some of these springs may also be arranged on the impulse stage or in empty spaces in the felloe of escape wheel 1. These springs may also be arranged laterally in one or several planes parallel to the first impulse plane and the second stopping plane.

These springs forming return means 7 and 9 may also be arranged side by side in two parallel planes.

In order to reduce torque consumption, and thus energy consumption, there may be a multiple release tooth 6 with surfaces that cooperate in succession with an unlocking surface 23 of balance 20, the radial amplitude of said surfaces being dependent upon the angular position thereof, for example staged surfaces in the form of steps.

In a first embodiment, seen in FIGS. 1 to 7, the first radial direction S1 is centripetal.

Figure 8:
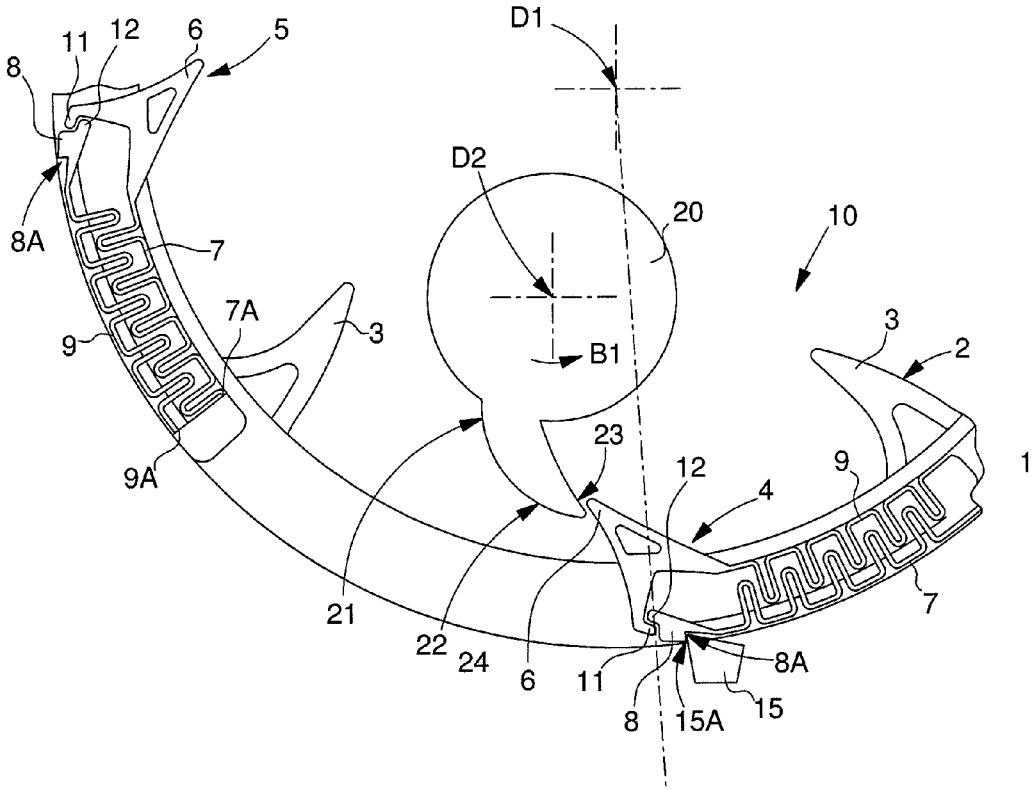
FIG. 8 shows a schematic, partial, plan view of an escape mechanism according to the invention incorporating another variant of the escape wheel according to the invention, in a release phase.

In a second embodiment seen in FIG. 8, the first radial direction S1 is centrifugal.

Escape wheel 1 according to the invention is preferably and advantageously in a single-piece. This allows perfect alignment of the two levels formed by the first toothed impulse wheel 2 in a first impulse plane and the second toothed release wheel 4 in a second stopping plane.

Very advantageously, escape wheel 1 is made of a micromachinable material, or silicon, or quartz or a compound thereof, or an alloy derived from MEMS technology, or an alloy such as that obtained by the DRIE or LIGA methods, or in an at least partially amorphous material. These methods can produce a complex, multi-level component such as escape wheel 1 according to the invention.

The invention further concerns an escape mechanism 10 including a plate 13 and at least one escape wheel 1 of this type, pivotally moveable relative to said plate 13 and arranged to receive a pivoting torque from energy transmission or storage means 14, which may or may not be integrated in mechanism 10, such as a gear train, a barrel, rotor or suchlike. This mechanism 10 also includes at least one balance 20 pivoting about a balance axis D2 and including at least one impulse surface 21, one manoeuvring surface 22 and one unlocking surface 23.

According to the invention, for each escape wheel 1, plate 13 of mechanism 10 includes a stop member 15 which is arranged to cooperate in succession with each locking tooth 8 in its stop position, via cooperation between a limit stop surface 15A of stop member 15 and a stop surface 8A of locking tooth 8, in order to block the pivoting of escape wheel 1 in one direction of pivoting P when locking tooth 8 is moved away from the stop position thereof by the corresponding release tooth 6.

Figure 1:
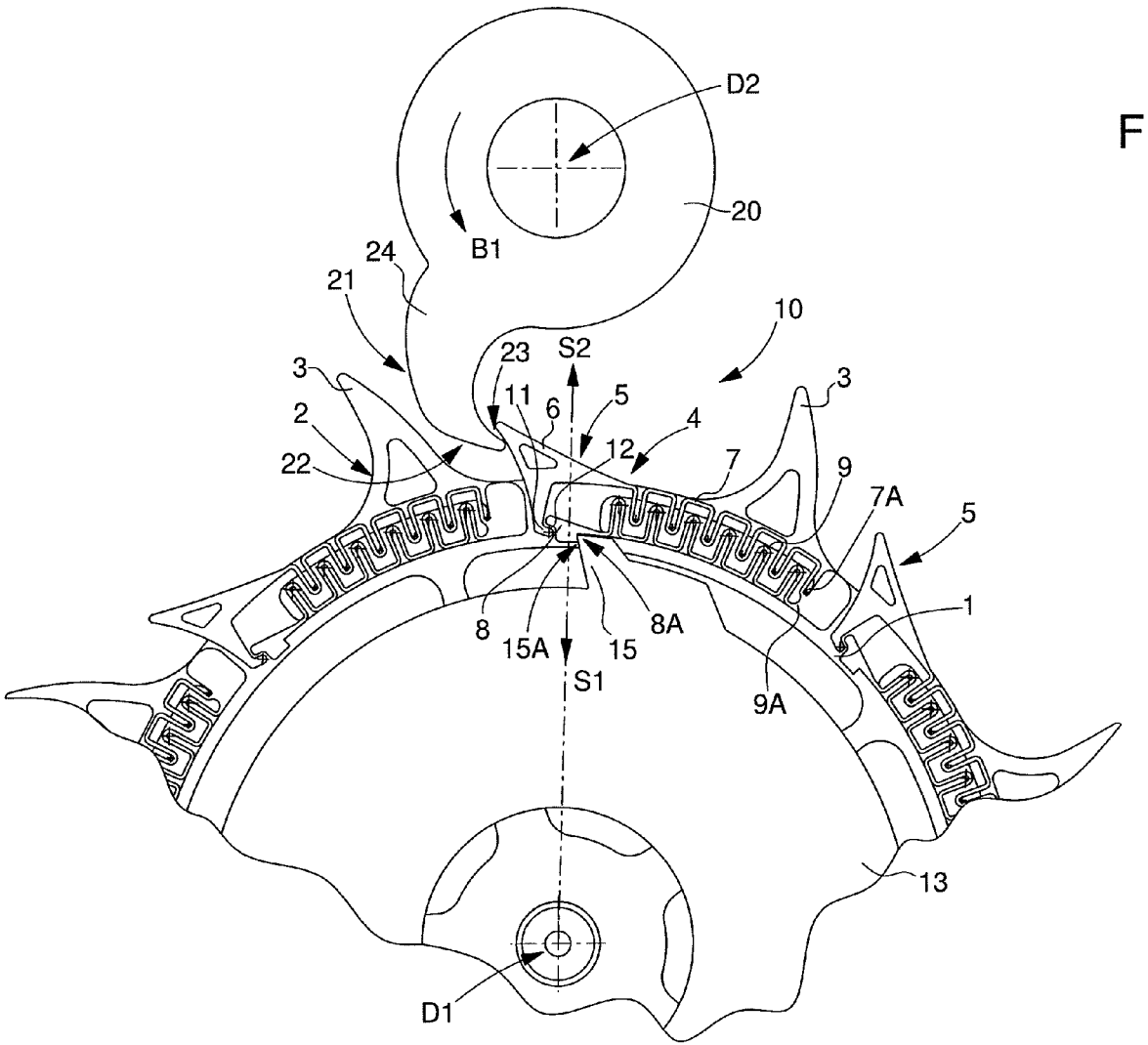
FIG. 1 shows a schematic, partial, plan view of an escape mechanism according to the invention, incorporating an escape wheel according to the invention, in a release phase.

As seen in FIG. 1, the trajectory of the unlocking surface 23 interferes in succession with that of each release tooth 6 in order, in a first direction of pivoting B1 of balance 20, to hook release tooth 6 and move it away from the position of balance in the second radial direction S2 by driving locking tooth 8 to move it away from the stop position thereof, and thus allow escape wheel 1 to pivot in direction P, as seen in the Figures.

FIG. 1 shows a release phase. At the start of this phase, wheel 1 is stopped against stop member 15 via cooperation between stop surface 8 of the locking tooth on the one hand, and limit stop surface 15A of stop member 15 on the other hand. When balance 20 pivots in direction B1, the unlocking surface 23 comprised in balance 20, for example on a pallet stone 24 or a roller or suchlike, comes into contact with a release tooth 6 of wheel 1. The unlocking surface drives the tooth and moves it away from the position of balance, in a centrifugal movement in direction S2. The drive means 11 for release tooth 6, formed, for example by a bank, abuts on the complementary drive means 12 of the corresponding locking tooth 8, then drives said locking tooth 8 in direction S2. This movement releases stop face 8 of the locking tooth from the hold of limit stop surface 15A of stop member 15.

Figure 2:
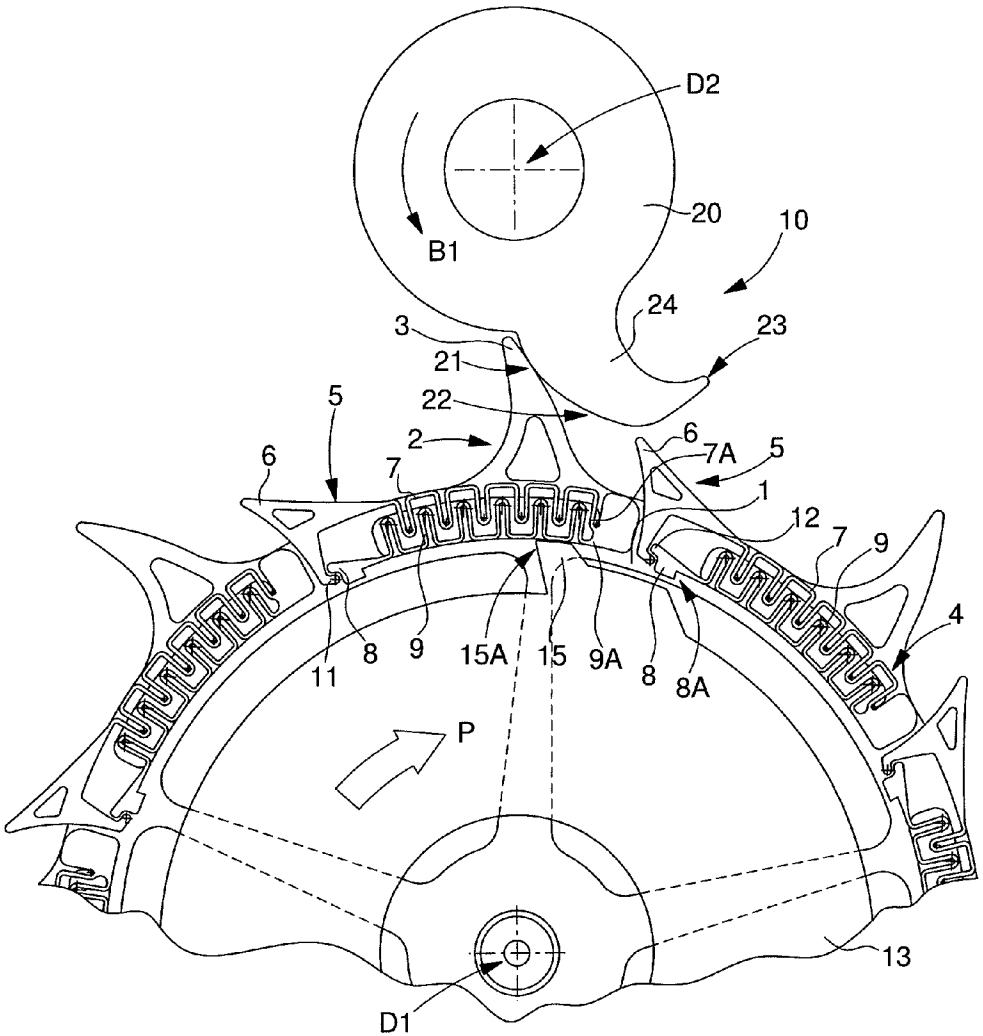
FIG. 2 shows a schematic, partial, plan view of the escape mechanism of FIG. 1, in an impulse phase.

FIG. 2 shows an impulse phase. After the preceding release phase, wheel 1 pivots freely in direction P until the next locking tooth 8 encounters limit stop member 15. During the course of pivoting, wheel 1 brings an impulse tooth 3 into abutment on impulse surface 21 of balance 20.

When escape wheel 1 is pivoting, an impulse tooth 3 is arranged to impart sufficient impulse to impulse surface 21 of balance 20 for a complete oscillation. During the next vibration of balance 20, in a second direction of pivoting B2 of balance 20, opposite to the first direction of pivoting B1, the trajectory of manoeuvring surface 22 interferes in succession with that of each release tooth 6 to push the latter in first radial direction S1, so as to allow balance 20 to continue to pivot without releasing the locking tooth 8, associated with release tooth 6, from limit stop member 15.

This impulse tooth 3 is at a different level from that of the release teeth, more off-centre in a first variant of FIGS. 1 to 7, where the pivot axis D1 of wheel 1 and D2 of balance 20 are on either side of the felloe of escape wheel 1. Then, conversely, closer to the centre in a second variant of FIG. 8, where the pivot axis D1 of wheel 1 and D2 of balance 20 are on the same inner side of the felloe of escape wheel 1, but off-centre in relation to each other.

Impulse tooth 3 then imparts sufficient impulse to impulse surface 21 of balance 20 to maintain the movement thereof, and particularly sufficient impulse for one complete oscillation of the balance in the event that escape mechanism 10 is a detent escape mechanism. Once the impulse is completed, wheel 1 continues to pivot until the next locking tooth 8 encounters limit stop member 15, when it is held stopped.

Figure 3:
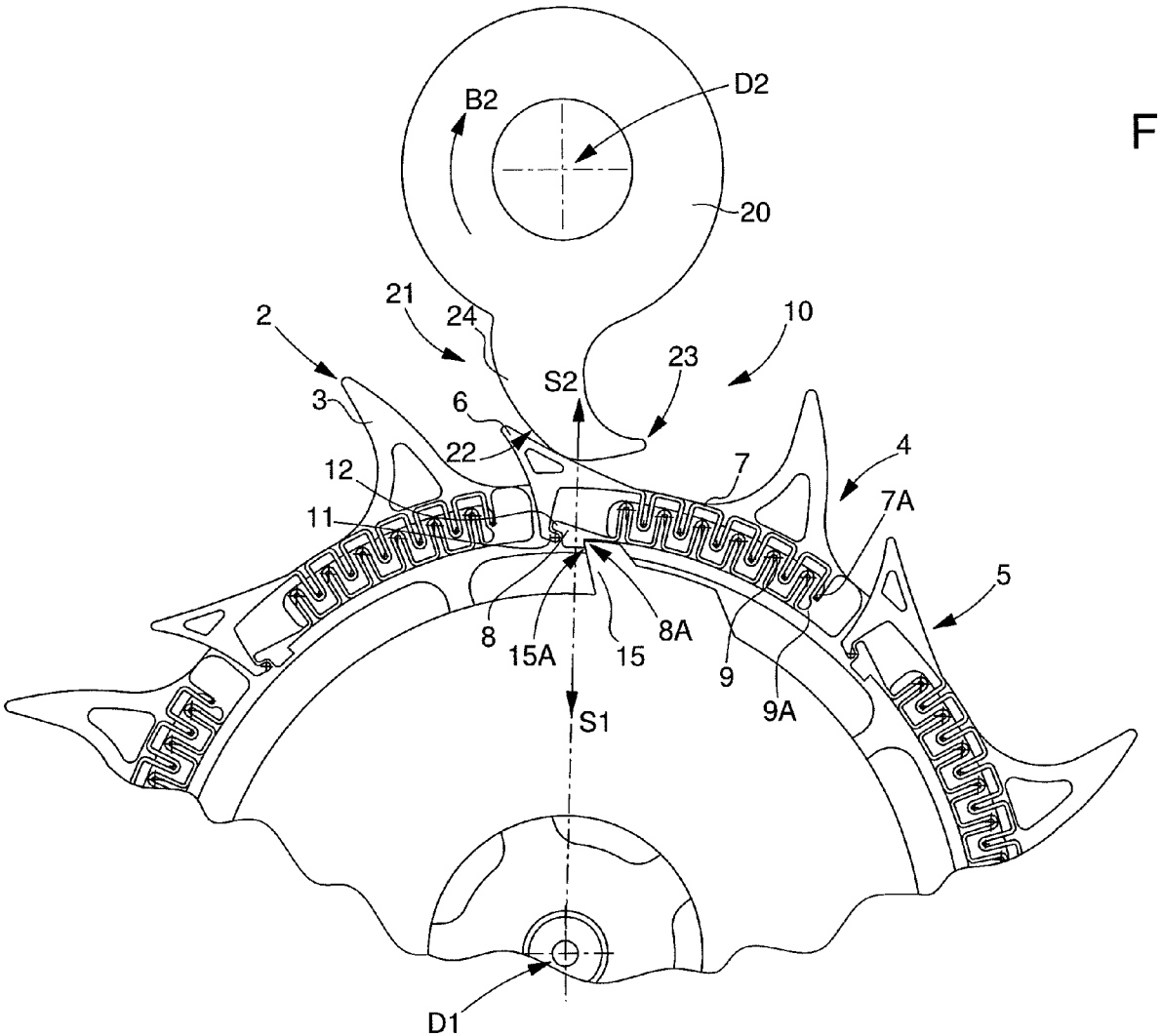
FIG. 3 shows a schematic, partial, plan view of the escape mechanism of FIG. 1, in an unlocking phase.

During the next vibration of balance 20 in a second direction of pivoting B2 of the balance opposite to the first direction of pivoting B1, as seen in FIG. 3 which illustrates an unlocking or dead phase, the trajectory of manoeuvring surface 22 of the balance interferes in succession with that of each release tooth 6 to push the latter in radial direction S1, so as to allow the balance to continue to pivot, without thereby releasing the locking tooth 8 associated with release tooth 6 from stop member 15, since drive means 11 and complementary drive means 12 are devised to only cooperate in one direction, which is second radial direction S2. Consequently, when release tooth 6 moves in the first radial direction S1, it does not drive locking tooth 8, which remains in position on stop member 15, and locks wheel 1 in position.

Advantageously, in a preferred embodiment seen in the Figures, impulse surface 21, manoeuvring surface 22 and unlocking surface 23 are arranged on the same pallet 24 carried by balance 20. Naturally, it is also possible to separate these elements, as in the prior art, by distributing them over various fingers or pallets.

The Figures show these surfaces of balance 20 over the entire width thereof, but they may equally well be distributed differently with impulse surface 21 on a first balance impulse plane and manoeuvring surface 22 and unlocking surface 23 on a second balance stopping plane.

Preferably, escape mechanism 10 is a detent escape mechanism and includes an anti-trip mechanism 30 for angularly limiting the escapement in the event of a shock to the balance.

Figure 9:
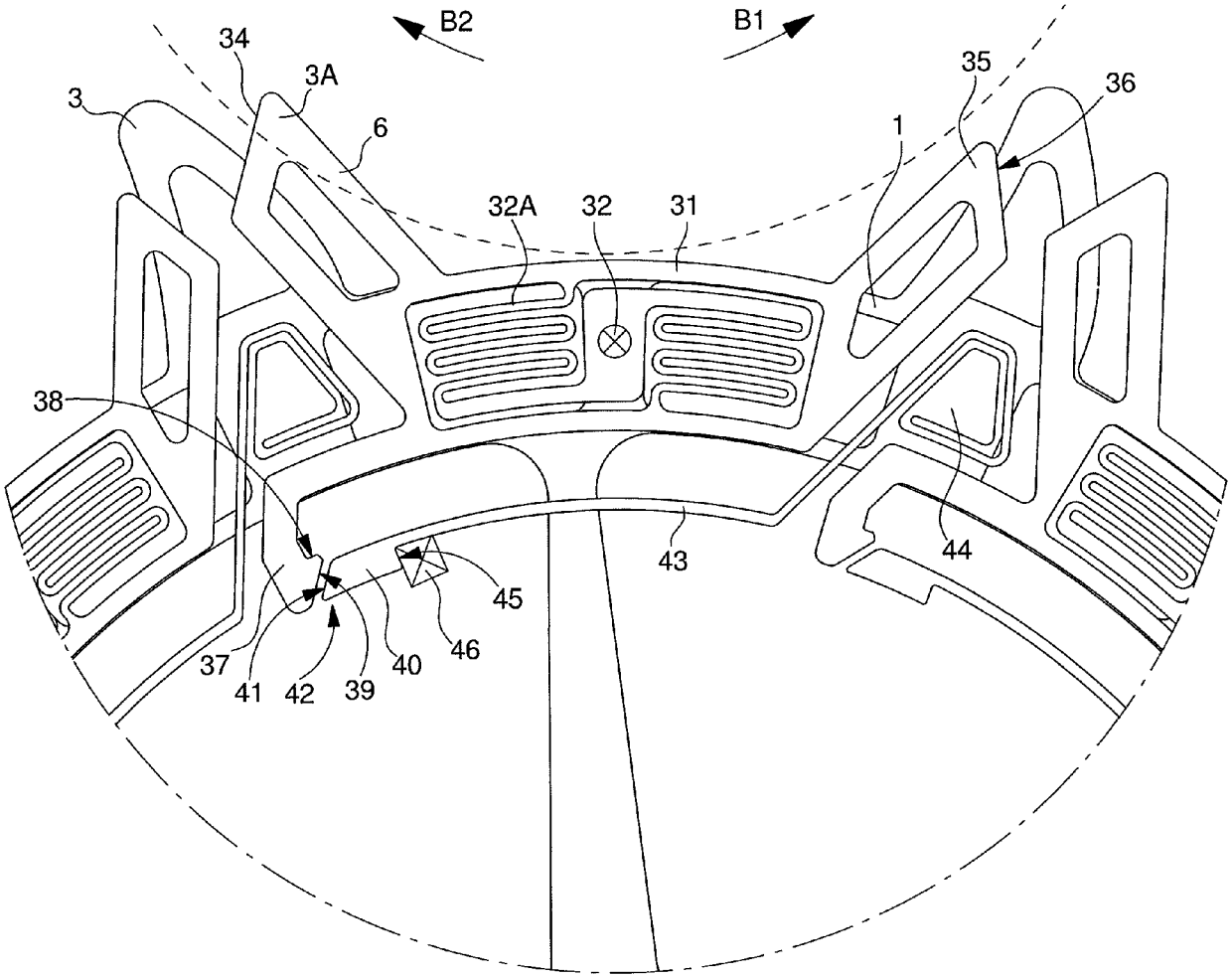
FIG. 9 shows a schematic, partial, plan view of an anti-trip device comprised in an escape mechanism according to the invention, in a first stop position.
Figure 10:
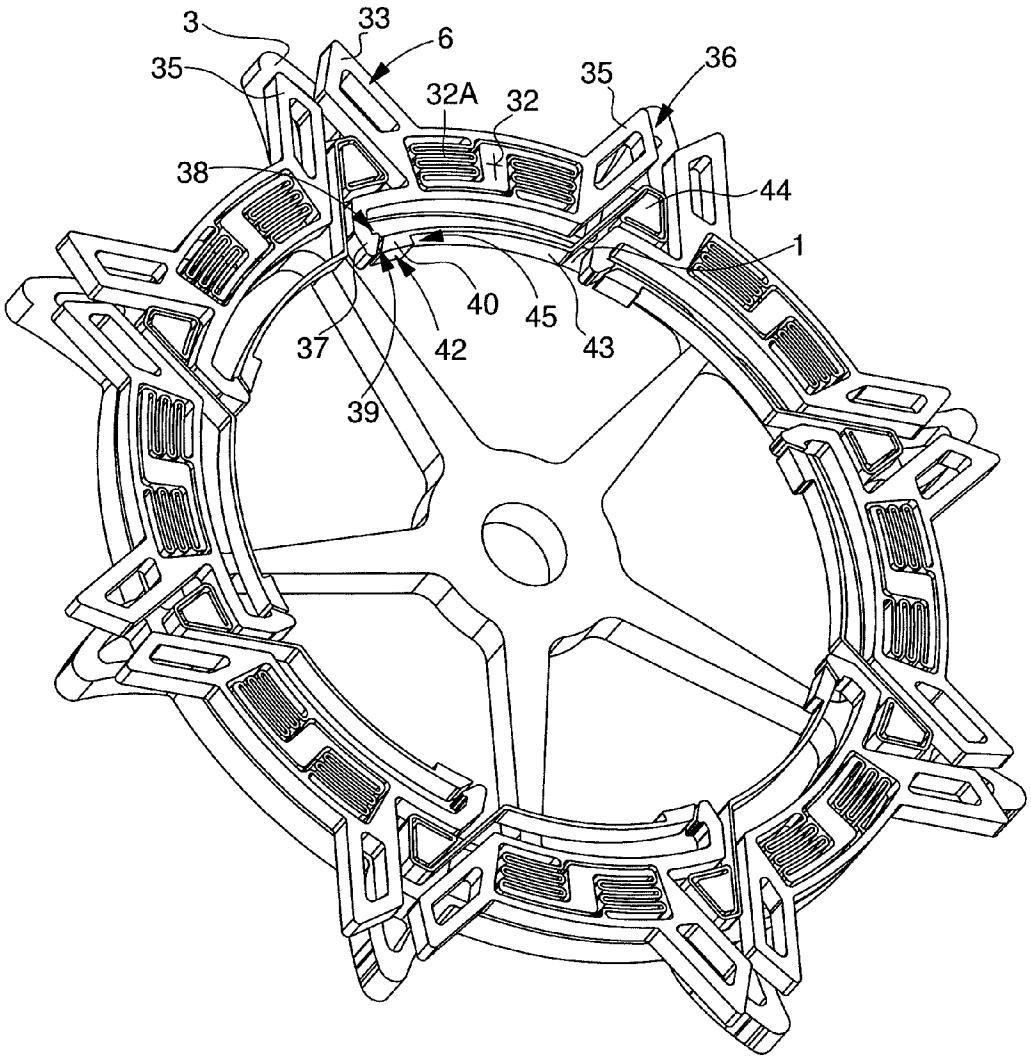
FIG. 10 shows a perspective view of the device of FIG. 9.

A non-limiting example of this type of anti-trip mechanism 30 is shown in FIGS. 9 and 10. It includes a lever 31, pivotally mounted on the felloe of an escape wheel. In the particular application to escape wheel 1 according to the invention, lever 31 is pivotally mounted on a pivot 32, preferably on at least one moveable gear 5 and more particularly on each moveable gear 5. Lever 31 includes a first arm 33, which includes a first limit stop surface 34, and a second arm 35 which includes a second limit stop surface 36.

Lever 31 is returned to a return position shown in FIG. 9 by return means 32A, particularly at least one spring, for example a spiral spring as seen in FIG. 9. The angular pivoting travel of lever 31 is limited, in particular and advantageously, by the springs forming return means 32A, to form a stop member that can absorb the impact force of balance 20 on surfaces 34 or 36 in the event of a shock to the timepiece and any racing of the balance. Lever 31 has a third arm 37 which includes a hooking surface 38 and an oblique support surface 39. These surfaces are arranged to cooperate with a hook 40 which is moveable relative to the third arm 37, respectively on a complementary hooking surface 42 or a complementary oblique support surface 41 comprised in said hook 40. This hook 40 is hinged via a spring 43 to a fixed point 44 of the felloe of escape wheel 1, as seen in FIG. 9, or to a point on the actual lever 31. This spring 43 tends to return the hook to the opposite side to the balance, i.e. towards the centre of escape wheel 1 in the case of FIG. 9. This hook 40 includes a stop surface 45, arranged to cooperate with a fixed stop member 46 connected to plate 13.

When, in normal mode, after impulse tooth 3 has given the impulse to balance 20, balance 20 finishes its vibration in the anti-clockwise direction B1, then returns to make the next vibration in the opposite, clockwise direction B2, the movement of the balance starts to push in release tooth 6 and also starts the winding of lever 31 by causing hooking surface 38 of arm 37 to cooperate with the complementary hooking surface 42 of hook 40. In the event that, after a shock, balance 20 races in the opposite direction B2 and tries to perform an additional revolution, it is stopped by the second limit stop surface 36 of second arm 35, which projects above the felloe of wheel 1 and immobilises the balance.

When, in normal mode, balance 20 finishes its return vibration in the clockwise direction B2 normally, at the end of its pivoting movement, it restarts in anti-clockwise direction B1, it then lifts release tooth 6 and locking tooth 8 into the position of FIG. 1 and allows wheel 1 to pivot in its single direction of pivoting P. At the same time, by pushing second arm 35, it unhooks hook 40 of fixed stop member 46 secured to the plate, and spring arm 43 then returns the balance to the correct level. Balance 20 winds lever 31 into the FIG. 9 position, unhooking hooking surface 38 of arm 37 from complementary hooking surface 42 of hook 40, and arm 37 then moves into abutment, via support surface 39 thereof, on complementary support surface 41 of hook 40, which is pushed back towards arm 37 under the action of spring 43 thereof.

The oblique support surface 39 has a dual function: on the one hand, cooperating to maintain abutment with complementary support surface 41 of hook 40 and on the other hand, a ramp function, which enables escape wheel 1 to overcome the obstacle formed by fixed stop member 46, once the impulse has been given and said wheel is released by hook 40 hooking onto arm 37 via surfaces 38 and 42 which are in lower wound contact. Indeed, at this stage, the bottom part of the moveable gear is formed by the single oblique surface 39, which will then rest on fixed stop member 46, which it will easily be able to overcome because of the inclination thereof.

If, after a shock, balance 20 races and tries to perform another revolution in the first direction of pivoting B1 of the balance, it collides with the first limit stop surface 34, which projects above the felloe of wheel 1, as shown in FIG. 9, and is thereby immobilised.

It is clear that fixed stop member 46 may be formed by stop member 15, which is already used for hooking moveable gear 5. Likewise, hook 40 may coincide with locking tooth 8, since the stop surface 45 thereof is merged with limit stop surface 15A, complementary hooking surface 42 being one of the complementary hooking means 12 and support surface 41 another surface of said means. The third arm 37 may be formed by the bottom part of release tooth 6, and the hooking surface 38 thereof corresponds to drive means 11 of release tooth 6. Thus, moveable gear 5 described hereinbefore may easily be also arranged to form this anti-trip mechanism. Indeed, release tooth 6 need only be converted into a lever 31, which is substantially symmetrical relative to a pivot 32 in order to adapt return means 7, which then becomes return means 32A. The bottom part of release tooth 6 is modified to form the third arm 37 with the surfaces 38 and 39 thereof, whereas locking tooth 8 is also modified by adding an inclined support surface 41.

It is clear that this anti-trip device 30, more specifically developed to take advantage of the architecture of moveable gear 5, can also be used, as it is, for other types of detent escapement mechanisms.

In a particular version, corresponding to the second embodiment of FIG. 8, escape mechanism 10 includes at least one balance 20 and one escape wheel 1, whose pivot axis D1 and D2 are on the same inner side of the felloe of escape wheel 1.

In a particular version, not shown in the Figures, for each balance 20, escape mechanism 10 includes two escape wheels 1 pivoting in opposite directions to each other.

In another version, not shown in the Figures, for each balance 20, escape mechanism 10 includes at least two escape wheels 1 pivoting in the same direction, and corresponding to different impulse positions.

In a particular embodiment, tending to reduce the number of components, balance 20 is made in a single-piece with plate 13.

For the same reason, in another version which can be combined with the preceding one, balance 20 is made in a single piece with at least one spiral spring, as disclosed in EP Patent Application No. 2 104 008 in the name of the Applicant.

In a version with a minimum number of components, escape mechanism 10 has two parts:

a first single-piece part includes plate 13, at least one balance 20, and at least one spiral spring coupled to each balance 20. In a variant, it does not have a spiral spring, the alternative construction of balance 20 integrating the return function allowing the oscillation movement of the balance, as in the embodiment disclosed in Swiss Patent Application No. 01198/10 in the name of the Applicant. Plate 13 advantageously has pivoting guide means arranged for guiding at least one escape wheel 1.

a second single-piece part includes at least one escape wheel 1 according to the invention, which has complementary guide means arranged to cooperate with said plate guide means to guide the pivoting of the escape wheel. Each wheel 1 is arranged to be coupled to a balance 20.

Preferably, all or part of this escape mechanism is made in a micro-machinable material, or silicon, or quartz or a compound thereof, or an alloy derived from MEMS technology, or an alloy such as that obtained by the DRIE or LIGA methods, or in an at least partially amorphous material. Preferably, all of the components thereof are made in a material of this type or via a method of this type.

The embodiment of the invention provides a detent escape mechanism which is simple, reliable and efficient.

To further improve the energy efficiency thereof, it is desirable to apply a tribological treatment to all or part of the friction surfaces, i.e. for escape wheel 1, impulse teeth 3 and release teeth 4 and for balance 20, impulse surface 21, manoeuvring surface 22 and unlocking surface 23, so as to reduce the level of friction. The same is true for surface 8A of locking tooth 8 and surface 15A of stop member 15, to facilitate the exit of escape wheel 1 from the stop position without wasting energy.

The invention also concerns a timepiece movement 100 including energy storage and transmission means for transmitting pivoting torque and including at least one escape mechanism 10 of this type, arranged to be driven by the pivoting torque, and/or at least one escape wheel 1 of this type, arranged to pivot under the effect of the pivoting torque and to transmit said torque in the form of a periodic impulse to a balance 20 comprised in movement 100.

The invention also concerns a timepiece 1000 including at least one timepiece movement 100 of this type and/or at least one escape mechanism 10 of this type, and/or at least one escape wheel 1 of this type.

The invention has the great advantage of grouping together all the escapement functions in a single component.

The possibility of making the escape wheel according to the invention via a MEMS, LIGA, DRIE or similar method and especially from silicon, which is particularly advantageous for its intrinsic elastic properties, which, furthermore, enables return means to be made inside the component, ensures that perfect geometry is obtained, and in particular ensures the alignment and angular shift of two levels of toothing, the toothed impulse wheel and the toothed release wheel. The perfect relative positioning of the release teeth and locking teeth is also ensured.

This type of escape wheel or this type of escape mechanism can easily be integrated in existing movements. The invention further offers considerable space saving, which enables other functionalities of the movement or timepiece concerned to be housed in the middle part of the timepiece.

In the embodiment presented in this description for the preferred application to a detent escapement, the high level of precision of a detent escapement is ensured. The invention also offers potential improvement in efficiency and thus in the power reserve.

The compactness of the invention means that, for top of the range movements, the function can be doubled, for example with two coupled escape wheels, without taking up excessive space.

What is claimed is:

1. An escape wheel for a timepiece mechanism, including a plurality of toothed wheels, which are coaxial, pivot synchronously about a pivot axis and include at least a first toothed impulse wheel in a first impulse plane and at least a second toothed release wheel in a second stopping plane, parallel to or merged with the first impulse plane, wherein said second toothed release wheel includes at least one moveable gear which includes, on the one hand, at least one release tooth, radially moveable relative to said pivot axis and returned to a position of balance by first return means, and on the other hand, at least one locking tooth, returned in a first radial direction towards a stop position by second return means, and further wherein said release tooth includes drive means, arranged to cooperate, when said release tooth is driven in a second radial direction opposite to said first radial direction, with complementary drive means comprised in said locking tooth to drive said locking tooth in said second radial direction, and wherein, when said release tooth is driven in the first radial direction, said drive means is arranged to move at a distance from said complementary drive means without driving said locking tooth.

2. The escape wheel according to claim 1, wherein said impulse wheel includes the same number of impulse teeth, with tips pointing in said second radial direction, as said second release wheel has moveable gears, each of which includes a release tooth with a tip pointing in said second radial direction, and wherein said impulse teeth are alternated with said release teeth.

3. The escape wheel according to claim 1, wherein said first return means and said second return means are elastic return means.

4. The escape wheel according to claim 3, wherein said release tooth forms the end of a first spring, the other end of which is embedded in a structure comprised in said escape wheel, and wherein said locking tooth forms the end of a second spring, the other end of which is also embedded in said structure.

5. The escape wheel according to claim 1, wherein said first radial direction is centrifugal.

6. The escape wheel according to claim 1, wherein said first radial direction is centripetal.

7. The escape wheel according to claim 1, wherein it is in a single piece.

8. The escape wheel according to claim 7, wherein it is made of a micro-machinable material, or silicon, or quartz or a compound thereof, or of an at least partially amorphous material.

9. The escape mechanism including a plate and at least one escape wheel according to claim 1 arranged for receiving a pivoting torque from energy transmission or storage means, which may or may not be integrated in said mechanism, and at least one balance, which pivots about a balance axis and includes at least one impulse surface, one manoeuvring surface and one unlocking surface, wherein said escape wheel and said balance are pivotally moveable relative to said plate, wherein, for each said escape wheel, said plate includes a stop member, which is arranged to cooperate in succession with each said locking tooth in its said stop position to block the pivoting of said escape wheel, and to allow said escape wheel to pivot when said locking tooth is moved away from the stop position thereof by said corresponding release tooth.

10. The escape mechanism according to claim 9, wherein the trajectory of said unlocking surface interferes in succession with that of each said release tooth in order, in a first direction of pivoting of said balance, to hook said release tooth and move the latter away from said position of balance in said second radial direction by driving said locking tooth to move the latter away from said stop position thereof and to allow said escape wheel to pivot.

11. The escape mechanism according to claim 10, wherein, during said pivoting of said escape wheel, an impulse tooth is arranged to impart sufficient impulse to said impulse surface of said balance for one complete oscillation, and further wherein, during the next vibration of said balance in a second direction of pivoting of said balance, opposite to said first direction of pivoting, the trajectory of said manoeuvring surface interferes in succession with that of each said release tooth to push the latter in the first radial direction so as to allow said balance to continue to pivot without releasing said locking tooth, associated with said release tooth, from said stop member.

12. The escape mechanism according to claim 9, wherein said impulse surface, said manoeuvring surface and said unlocking surface are arranged on the same pallet carried by said balance.

13. The escape mechanism according to claim 9, wherein it is a detent escape mechanism and includes an anti-trip mechanism.

14. The escape mechanism according to claim 9, wherein it includes at least one said balance and one said escape wheel, which are coaxial to each other.

15. The escape mechanism, according to claim 9, wherein it includes, for each said balance, two said escape wheels pivoting in opposite directions to each other.

16. The escape mechanism according to claim 9, wherein said balance is made in a single piece with said plate.

17. The escape mechanism according to claim 9, wherein said balance is made in a single piece with at least one spiral spring.

18. The escape mechanism according to claim 9, wherein it includes a first single-piece part grouping together said plate, including pivoting guide means arranged for guiding at least one said escape wheel, and said first single-piece part further including at least one said balance, at least one said spiral spring coupled to each said balance, and further wherein it includes a second single-piece part including at least one said escape wheel including complementary guide means arranged to cooperate with said guide means for said plate in order to guide said escape wheel as it pivots, each said wheel being arranged to be coupled to one said balance.

19. The escape mechanism according to claim 9, wherein it is made of micro-machinable material, or silicon, or quartz or a compound thereof, or an alloy derived from MEMS technology, or an alloy obtained via the DRIE or LIGA methods, or made of an at least partially amorphous material.

20. A timepiece movement including energy storage and transmission means for transmitting pivoting torque and including at least one escape mechanism according to claim 9, arranged to be driven by the pivoting torque, where said at least one escape wheel is arranged to pivot under the effect of said pivoting torque and to transmit said torque in the form of a periodic impulse to a balance comprised in said movement.

21. The timepiece movement including energy storage and transmission means for transmitting pivoting torque including at least one escape wheel according to claim 1, arranged to pivot under the effect of said pivoting torque and to transmit said torque in the form of a periodic impulse to a balance comprised in said movement.

22. The timepiece including energy storage and transmission means for transmitting pivoting torque and including at least one escape wheel according to claim 1, arranged to pivot under the effect of said pivoting torque and to transmit said torque in the form of a periodic impulse to a balance comprised in said movement.

* * * * *